United States Patent [19]

Karamanolis et al.

[11] 4,258,864

[45] Mar. 31, 1981

[54] TOOTHPASTE DISPENSER

[76] Inventors: Peter K. Karamanolis; Peter W. Tsaoussis, both of 231 Ellington Rd., East Hartford, Conn. 06108

[21] Appl. No.: 113,652

[22] Filed: Jan. 21, 1980

[51] Int. Cl.[3] ..... B65D 35/54

[52] U.S. Cl. ..... 222/96; 222/101; 222/105; 222/333

[58] Field of Search ..... 222/95, 96, 97, 98, 222/101, 102, 105, 333

[56] References Cited

U.S. PATENT DOCUMENTS

| | | | |
|---|---|---|---|
| D. 199,780 | 12/1964 | English . | |
| D. 227,836 | 7/1973 | Roiko . | |
| 1,839,542 | 1/1932 | Ferguson . | |
| 1,887,720 | 11/1932 | Robinson . | |
| 2,085,673 | 6/1937 | Roache | 222/96 |
| 2,507,651 | 5/1950 | Small . | |
| 2,515,440 | 7/1950 | Cicero . | |
| 2,537,008 | 1/1951 | Abbott . | |
| 2,760,681 | 8/1956 | Arquellas et al. . | |
| 2,822,111 | 2/1958 | Tripoli . | |
| 2,830,733 | 4/1958 | Garibaldi . | |
| 2,936,006 | 5/1960 | Henley . | |
| 3,194,440 | 7/1965 | Watson . | |
| 3,232,488 | 2/1966 | Headberg | 222/333 |
| 3,241,721 | 3/1966 | Freeman . | |
| 3,417,902 | 12/1968 | Mirka | 222/96 |
| 3,860,147 | 1/1975 | Vessio et al. | 222/96 |
| 4,010,873 | 3/1977 | Mardirossian . | |

*Primary Examiner*—H. Grant Skaggs

[57] ABSTRACT

An automatic toothpaste dispenser employs a roller-type squeeze device that is driven along the toothpaste tube simultaneously with the opening of a gate that permits the toothpaste to flow. After the desired amount of toothpaste has been dispensed, the roller is automatically retracted and the gate is simultaneously closed. However, the retraction of the gate only continues until the gate is closed, which results in a ratchet-like effect, the roller being retracted a smaller distance than that by which it is advanced.

16 Claims, 16 Drawing Figures

TOOTHPASTE DISPENSER

BACKGROUND OF THE INVENTION

The present invention relates to toothpaste dispensers. Although the teachings of the present invention are particularly advantageous for elctrically operated dispensers, manual toothpaste dispensers can also be made based upon its teachings.

The ordinary toothpaste tube is a device that is simple and easy to use, and it has gained wide acceptance. In the hands of most adults, it provides neat as well as simple operation. However, children have proven themselves capable of employing the toothpaste tube in such a manner so as to cause a considerable mess. It is not uncommon for children to neglect to replace the cap on a toothpaste, thus sometimes allowing the toothpaste to leak out and more often allowing the toothpaste to dry out in the tube neck. Furthermore, children have a tendency not to squeeze the tube from the end opposite the mouth, and the result is wasted toothpaste. Leakage can also result from this type of squeezing because creases tend to turn up in parts of the tube that still contain toothpaste. For families with young children, then, a toothpaste dispenser can be an advantage if it makes dispensing the toothpaste simpler, and particularly if it reduces the occurrence of messes.

If a toothpaste dispenser is to gain acceptance, then, attention must be paid to reducing the possibility of leakage and waste of toothpaste. If a dispenser merely makes dispensing easier but is still likely to cause a mess, it is less likely to be accepted. The result of this requirement is that the toothpaste dispenser must provide an effective gate means at the tube outlet so as to prevent leakage, and it is desirable that the device be so designed that opening of the gate and dispensing of the toothpaste can be accomplished in a single operation.

Numerous devices have been proposed for achieving this result. For instance, there is illustrated in U.S. Letters Patent No. 2,830,733 to Garibaldi a toothpaste tube that opens automatically when the paste is squeezed out but is closed again when the squeezing operation is finished. However, this device requires that the toothpaste tube be quite a bit more elaborate than those that currently have found acceptance, and the Garibaldi device has not enjoyed widespread use.

An arrangement that provides opening of the gate means and squeezing of a conventional tube in a single operation is illustrated in U.S. Letters Patent No. 2,537,008 to Abbott. The Abbott device is quite simple, but it is thought that the pivotal cover that serves as a squeeze means does not provide sufficient control over the amount of toothpaste dispensed. This is a drawback in a manual arrangement, and it could be a serious problem in an electric dispenser.

An arrangement that affords more control over the amount of toothpaste dispensed is illustrated in U.S. Letters Patent No. 2,936,006 to Henley, in which a roll is rotated as it progresses down the dispenser to squeeze a conventional toothpaste tube from the end opposite the tube mouth. However, the Henley device requires a separate operation for opening of the gate means, and it will be seen by comparison to the device of the present invention that adaptation for automatic opening of the gate means upon squeezing would present some problems unless the teachings of the present invention were employed.

It is the object of the present invention to provide operation that is an improvement over that afforded by prior art devices. It is another object to permit relatively fine control over the amount of toothpaste dispensed while automatically opening the gate means in the same operation that provides the dispensing. It is still another object to avoid the application of pressure to the tube between operations and thus avoid leakage.

SUMMARY OF THE INVENTION

The foregoing and related objects are achieved in a toothpaste dispenser that includes a housing having first and second axes and is adapted for the mounting of an elongated toothpaste tube in it with the longitudinal axis of the associated tube extending along the first axis. A squeeze means is movably mounted in the housing for movement along the first axis to squeeze the associated toothpaste tube mounted in the housing. A drive means is also mounted in the housing. It is operable in first and second directions and is operatively engaged with the squeeze means for moving it along the first axis to squeeze toothpaste out of the associated toothpaste tube mounted in the housing when the means is operated in the first direction. The drive means moves the squeeze means in the opposite direction when the drive means is operated in the second direction.

A gate means on the housing is movable between a closed position, in which the gate means is positioned to prevent the flow of toothpaste out of the assoicated toothpaste tube mounted in the frame, and an open position, in which flow is permitted. The gate means is operatively engaged with the drive means for movement of the gate means to the closed position when the drive means is operated in the second direction and for movement of the gate means to the open position when the drive means is operated in the first direction. The gate means remains in the open position when the motivating means continues to operate in the first direction. A means is also provided that is operable upon movement of the gate means to the closed position to stop the movement of the squeeze means in the opposite direction. The squeeze means is thereby enabled to start its squeezing action at successively farther-advanced positions along the associated toothpaste tube after successive closures of the gate means.

The drive means typically includes an elongated drive shaft having its longitudinal axis extending parallel to the first axis of the housing and mounted in the housing for rotation about its longitudinal axis. The drive means will ordinarily also include carriage means and gate operating means, the carriage and gate operating means being mounted on the drive shaft for movement alont it, and the squeeze means being mounted in the carriage means for movement with it along the drive shaft. The gate operating means is operatively connected to the gate means for movement of the gate means between the open and closed positions upon movement of the gate operating means along the drive shaft. The carriage means and the gate operating means are threadedly engaged with the drive shaft for movement of the gate operating means along the drive shaft to move the gate means toward its open position and movement of the carriage means and thereby of the squeeze means along the drive shaft to squeeze toothpaste out of the associated tube upon rotation of said drive shaft in one way. The threaded engagement produces movement of the gate operating means along the drive shaft to move the gate means toward its closed position and also produces movement of the carriage means and thereby of the squeeze means along the shaft in the opposite direction when the drive shaft is rotated the other way.

The drive means may include an electric motor mounted in the housing and operatively engaged with the drive shaft for rotation of the drive shaft upon operation of the electric motor. The drive means would further include circuit means connected to the electric motor, adapted for connection to a source of electric power, and operable when connected to the source of electric power to alternately apply the power in first and second modes to the electric motor to rotate the dirve shaft one way in first mode and the other way in the second mode. The means for stopping movement of said squeeze means could include switch means electrically interposed in the circuit means and operable by the reaching of the closed position by the gate means to interrupt the application of power in the second mode.

The squeeze means of the preferred embodiment includes a roll rotatably mounted in the carriage means for engagement with the associated toothpaste tube. The roll is permitted to rotate as the squeeze means is moved to squeeze toothpaste out of the associated toothpaste tube.

The switch means may conveniently be made to be operable by the gate means upon movement to the closed position to interrupt the application of power in the second mode. It may include a manually operable switch having two states, a first state in which the circuit means applies power to the electric motor in the first mode and a second state in which the circuit means applies electric power to the motor in the second mode, the switch being manually operable to assume the first state upon manual manipulation of the manually operable switch and biased to assume the second state upon release of the manually operable switch.

Also in the preferred embodiment, the threads on the drive shaft and the gate operating means that provide the threaded engagement between them are longitudinally positioned for disengagement when the gate operating means reaches its position on the shaft corresponding to the open position of the gate. Continued rotation of the drive shaft in th one way and thus continued squeezing is permitted without further movement of the gate in the direction of the open position, but rotation of the drive shaft in the other way when the gate means is in the open position causes movement of the gate operating means to move the gate means from the open position toward the closed position.

A second drive shaft may conveniently be provided that is operatively engaged with the motor and threadedly engaged with the carriage means and the gate operating means for simultaneous movement of the carriage means and the gate operating means along the first-mentioned drive shaft and the second drive shaft.

In one version of the invention, the drive means includes an elongated drive rod mounted in the housing with its longitudinal axis extending parallel to the first axis for longitudinal movement relative to the housing, the drive means further including carriage means and gate operating means engaging the drive rod for movement with it along the first axis. The squeeze means is mounted in the carriage means for movement with it and the gate operating means is operatively engaged with the gate means for movement thereof between the open and closed positions upon movement of the gate operating means with the drive rod. The carriage means engages the drive rod for longitudinal movement of the drive rod and the gate operating means to move the gate means toward the open position when the carriage means moves with the squeeze means to squeeze toothpaste out of the associated tube and for longitudinal movement of the drive rod and the gate operative means to move the gate means towared the closed position when the carriage means moves with the squeeze means in the opposite direction.

In this version, the drive means includes an electric motor mounted in the carriage means and operatively engaged with the frame for movement of the motor and the carriage along the first axis upon operation of the electric motor. The drive means further includes circuit means connected to the electric motor, adapted for connection to a source of electric power, and operable when connected to the source of electric power to alternately apply the power in first and second modes to the elctric motor. The motor, carriage means, and squeeze means move to squeeze toothpaste out of the associated tube when power is applied to the electrric motor in the first mode and move in the opposite direction when power is applied to the electric motor in the second mode. The means for stopping movement of the squeeze means includes switch means electrically interposed in the circuit means and operable by the reaching of the closed position by the gate means to interrupt the application of power in the second mode.

The drive rod in this version typically includes stop means for engaging the housing upon the drive rod's reaching the position corresponding to the open position of the gate means. The engagement of the housing by the stop means prevents further longitudinal motion of the drive rod with the carriage means and the squeeze means as they continue motion to squeeze toothpaste out of the associated toothpaste tube, but it permits motion of the drive rod with the carriage means and the squeeze means in the opposite direction. The engagement of the drive rod by the carriage means permits slipping of the drive rod relative to the carriage means when the stop means prevents further movement of the drive rod.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 4:
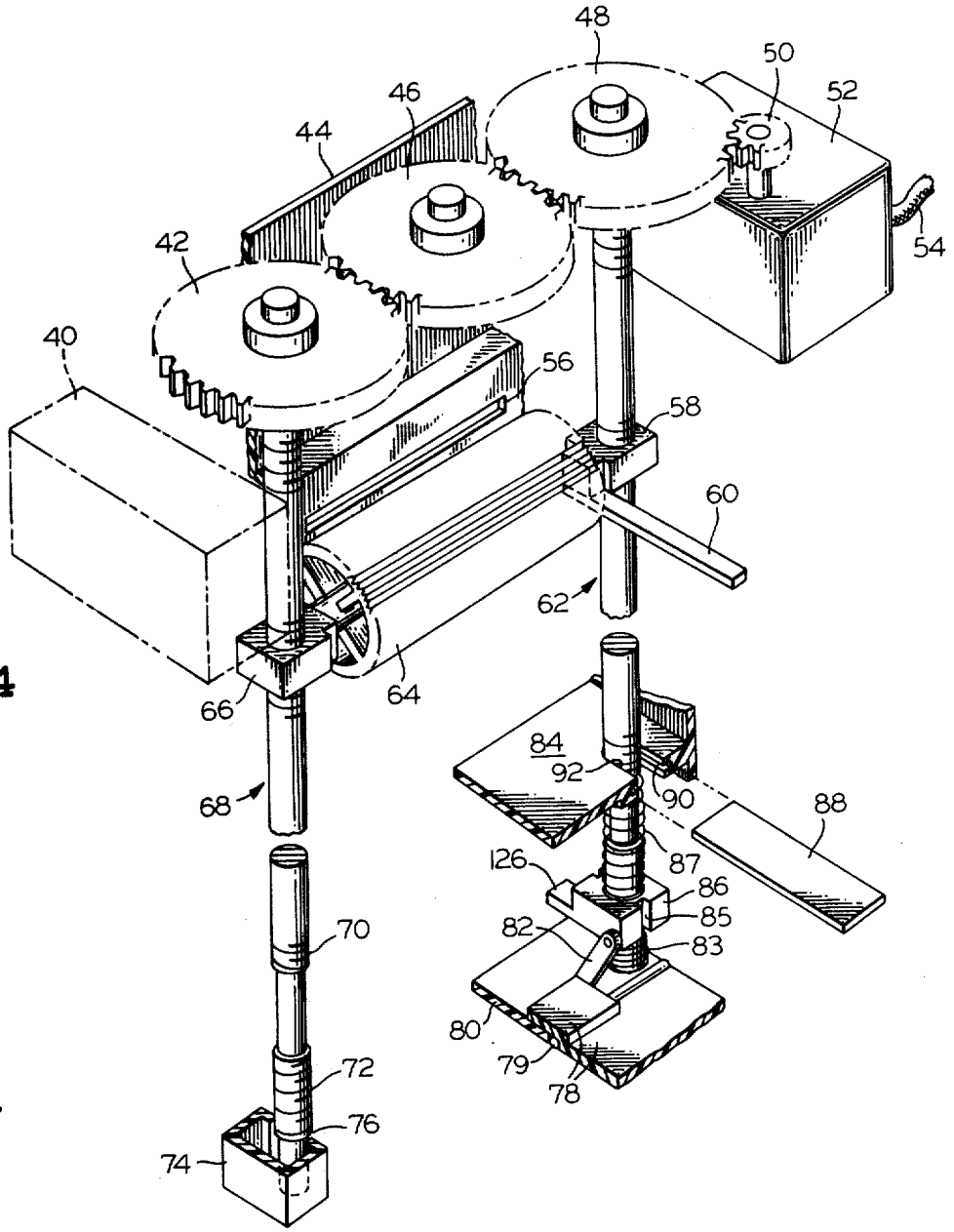
FIG. 4 is a perspective view of various of the interior parts of the dispenser.

The drawings illustrate a toothpaste dispenser in which an associated toothpaste tube 98 (FIG. 2) is squeezed by a roller 64 that advances down the tube to dispense toothpaste through a feed tube 102 after a gate 78 has been automatically moved out of the way. Referring briefly to FIG. 4, a motor 52 drives drive shafts 62 and 68 that vertically move carriage blocks 58 and 66. The drive shafts also vertically drive a door-operating device including block 86.

According to the present invention, roller 64 advances down the tube under the control of a human operator until the desired amount of toothpaste has been dispensed, and it then retracts only a predetermined distance. This takes pressure off the toothpaste tube but does not require the roller to be advanced from completely retracted position at the beginning of every operation of the dispenser. As a result, the motion of the roller can be made fairly slow, which results in a high degree of control over the toothpaste dispensed. This control is afforded without incurring the long delay involved in advancing the roller all the way from a completely retracted position at the low speed. This ratchet-like effect thereby provide significant advantages in toothpaste dispensers.

Figure 1:
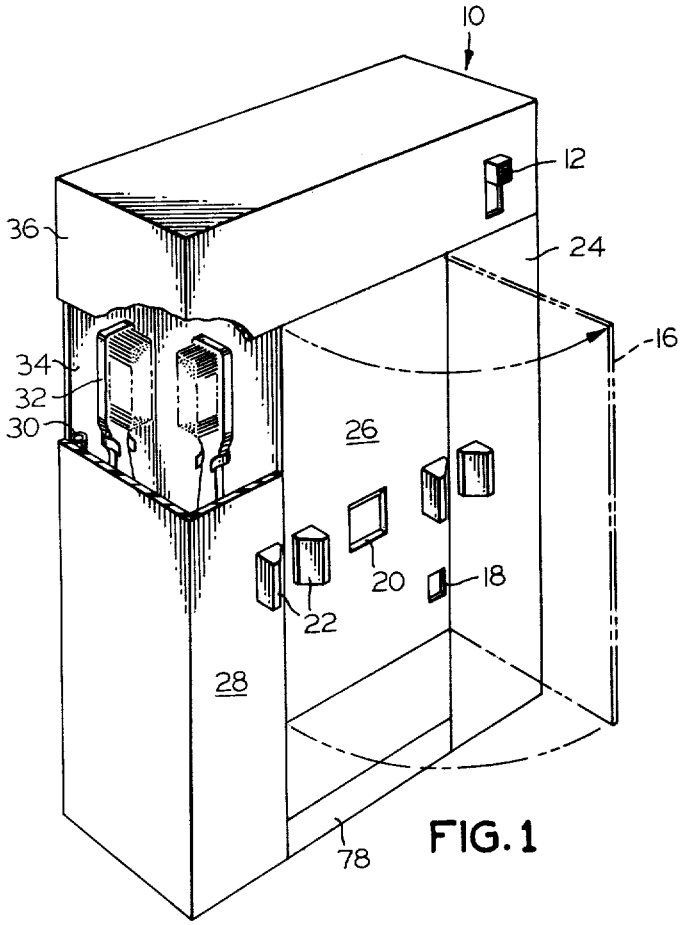
FIG. 1 is a perspective view, partly broken away, of a toothpaste dispenser that follows the teachings of the present invention.

FIG. 1 shows one embodiment of the present invention, consisting of a toothpaste dispenser designated generally by reference numeral 10. The dispenser provides two side doors 24 and 28 pivotably mounted on a rear wall 34. Doors 24 and 28 open to reveal chambers containing toothbrushes 32. A center door 26 is provided to permit access to the interior, which is necessary when the toothpaste tube is to be replaced. The door 26 has an actuating button 20 provided on it that is used for operation of the device. Depressing button 20 causes gate 78 to open and toothpaste to be dispensed. Releasing button 20 causes a small retraction of the roller 64 and closure of the gate 78. A second switch 12 provided in a top portion 36 of the dispenser housing is used to operate roller 64 to its completely retracted position. This permits removal of the associated toothpaste tube.

The front door 26 is provided with a window 18, which, as will be described in more detail below, provides an indication that the toothpaste tube is nearly empty. Various knobs 22 are provided for opening and closing doors 24, 26, and 28.

Figure 2:
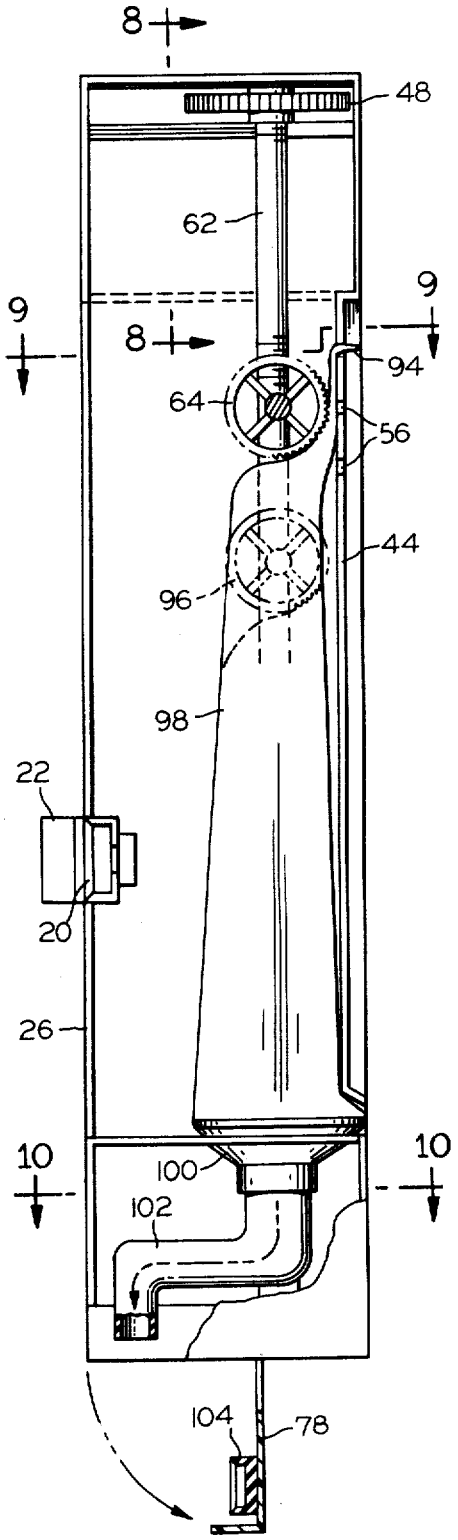
FIG. 2 is a side elevation, partly broken away but with cross-hatching eliminated for clarity, of the toothpaste dispenser of FIG. 1.
Figure 3:
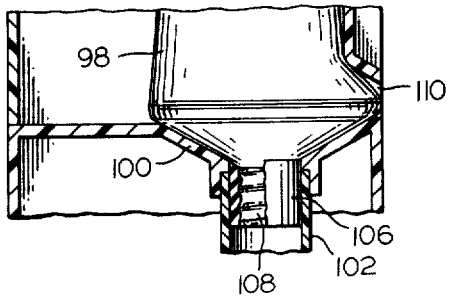
FIG. 3 is a side sectional view of the lower end of the dispenser.

Simultaneous reference to FIGS. 2 and 3 will reveal the manner in which a toothpaste tube is positioned in the dispenser. Several slots 56 are provided on an indented portion 44 of the rear wall of the housing. The several slots are provided for different tube sizes, one slot being provided for each conventional size. The tube end 94 opposite the outlet is inserted in one of the slots 56, and the tube is then bent downward so that the lower end of the indented portion 44 of the rear wall hits the tube just behind its neck. A frustoconical tube support 100 supports the toothpaste tube 98 at its shoulder, while the threaded neck 108 of the tube is inserted in a complementarily threaded gasket or seal 106 provided in a central bore of the tube support 100. Gasket 106 is resilient and permits insertion of the tube mouth without rotation of the tube. A transfer tube 102 seats in a counterbore portion of tube support 100 between tube support 100 and seal 106. Transfer of toothpaste from the toothpaste tube to transfer tube 102 is thereby effected without leakage of toothpaste.

Figure 8:
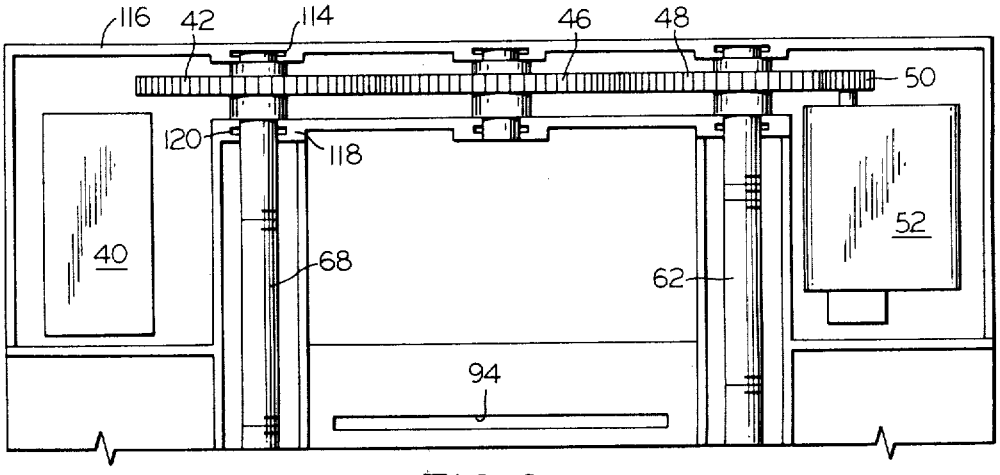
FIG. 8 is a sectional view with cross-hatching eliminated for clarity, of the dispenser taken at line 8—8 of FIG. 2.

Simultaneous reference to FIGS. 2 and 4 reveals the general organization of the drive train of the device. A motor 52 is mounted in the housing, and its shaft rotates a drive pinion 50, which in turn engages right drive gear 48. The rotational movement is transferred to left drive gear 42 by a central gear 46. As FIG. 8 illustrates, the gears are all appropriately mounted in the housing, as will be described in more detail below.

Left and right drive gears 42 and 48 drive identical drive shafts 62 and 68, both of which are employed for driving roller 64 and gate 78. Roller 64 is journaled in a carriage means that includes two carriage blocks 58 and 66. Carriage blocks 58 and 66 threadedly engage drive shafts 62 and 68, respectively, and rotation of shafts 62 and 68 by operation of motor 52 accordingly results in motion of roller 64 along the vertical axis of the dispenser. As phantom 96 in FIG. 2 suggests, advancement of roller 64 along the vertical axis of the dispenser causes the tube to be squeezed, and toothpaste is thus dispensed.

As FIG. 4 illustrates, shafts 62 and 68 are positioned by appropriate positioning ribs such as rib 84, which has a slot 92 for receiving shaft 62. Slot 92 is provided with a groove 90 that receives plate 88, which is, for instance, cemented into the slot to hold shaft 62 in the place.

Means for opening gate 78 are also threadedly engaged by drive shafts 62 and 68. As is illustrated both in FIG. 4 and in FIGS. 6 and 7, gate operating block 86 has a door drive arm 82 pivotably mounted on it, and drive are 82 is pivotably attached at its other end to door 78. The threads on shaft 62 that engage block 86 are the reverse of those that engaged block 58, so block 86 is advanced upward as carriage block 58 proceeds downward. As a result, block 86 and a corresponding block on shaft 68 operate door 78 to its open position as roller 64 is being advanced downward.

When block 86 has been lowered enough to move door 78 to its completely open position, its downward movement stops despite continued rotation of shaft 62 and thus the continued advancement of roller 64. This is because the threads on shaft 62 run out at that point, so block 86 is no longer threadedly engaged with shaft 62 when door 78 is completely open.

A spring 87 is provided between housing rib 84 and block to urge block 86 into engagement with the threads of shaft 62. This insures that block 86 will again engaged shaft 62 and accordingly be propelled downward when the shaft rotates to retract roller 64. As roller 64 is retracted, therefore, gate 78 is moved toward its closed position, in which a cap 104 closes against the lower end of transfer tube 102 to prevent further toothpaste from issuing from transfer tube 102. Cap 104 also prevents air from drying out the toothpaste.

Figure 5:
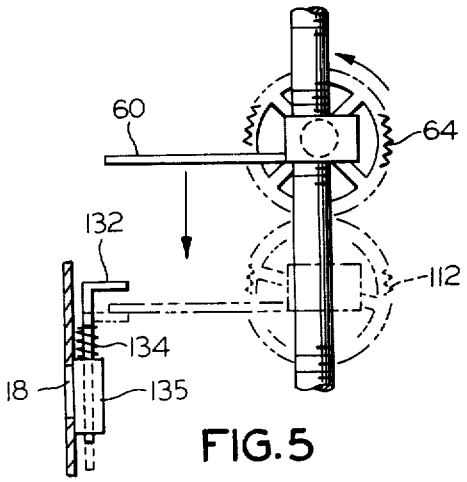
FIG. 5 is a side elevation of the device for indicating whether or not the toothpaste tube is empty.

FIG. 4 also shows an arm 60 extending toward the front of the housing from carriage block 58. The purpose of arm 60 is illustrated in FIG. 5, in which a scabbard 135 is shown mounted on door 26 behind window 18. A flag 32 is slidably mounted in scabbard 135 and biased by spring 134 to an upper position. As phantom 112 suggests, arm 60 engaged flag 132 when roller 64 is near the lower end of its travel, and this causes flag 132 to be seen through window 18 to indicate that the toothpaste tube is almost empty.

Figure 9:
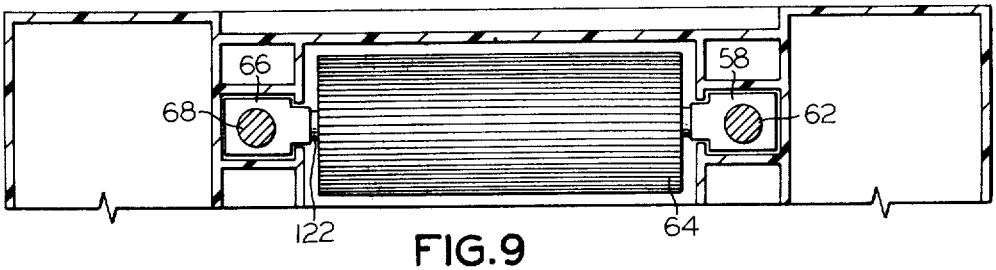
FIG. 9 is a sectional view taken at line 9—9 of FIG. 2.
Figure 10:
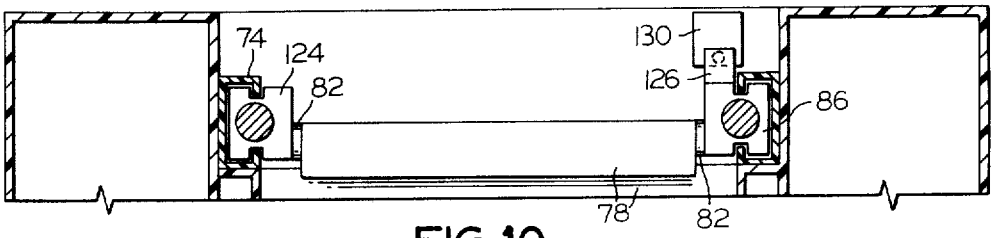
FIG. 10 is a sectional view taken at line 10—10 of FIG. 2.

FIGS. 8, 9, and 10 show in more detail a typical manner in which the gears, shafts, and carriages blocks can be mounted in the housing. FIG. 9 is a section taken at line 9—9 of FIG. 2, and it shows carriage blocks 58 and 66 from the top. It can be seen that the housing includes appropriate ribs for providing tracks along which blocks 58 and 66 can travel when propelled by shafts 62 and 68. FIG. 9 also shows roller axle 122, by which roller 64 is mounted on carriage blocks 58 and 66.

FIG. 8 is taken at line 8-8 of FIG. 9, and it shows the upper portion of the dispenser. It is seen that motor 52 is provided in a compartment in the housing from which it drives gear 48, which is mounted on shaft 62. Shafts 62 and 68 and gears 42, 46, and 48 are all mounted in the upper portion of the housing in a manner that is exemplified by the mounting of gear 42 and shaft 68. The top wall 116 of the housing and another rib or wall 118 spaced below it are both provided with slots such as slot 114, which is similar to slot 92 of FIG. 4. Each slot has a groove such as groove 120. Shaft 68 is received in the slots, and appropriate plates not shown in FIG. 8 are received in grooves and appropriately bonded to hold shaft 68 in place. As FIGS. 8 suggests, a similar mode of assembly holds gears 46 and 48 and shaft 62 in place. FIG. 10 illustrates the tracks provided for gate operating blocks 86 and 124. As is best appreciated by simultaneous reference to FIGS. 4 and 10, gate operating blocks 86 and 124 are provided with grooves such as 85 (FIG. 4) that receive flange portions of a C-shaped channel member such as channel member 74. The opening 76 in the C-shaped channel 74 is large enough to receive both the drive shaft and the grooved portion of the gate operating block.

Figure 11:
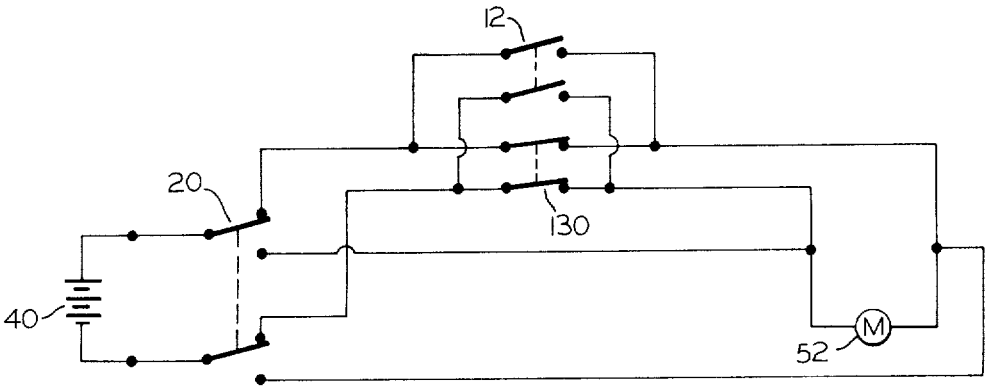
FIG. 11 is a schematic diagram of the electrical circuit employed in the dispenser of FIG. 1.

FIG. 11 is a schematic diagram of the control circuitry for the dispenser of FIG. 1. Reference numeral 40 in FIG. 11 refers to a battery suggested by a phantom 40 in FIG. 4. Of course, it is not necessary that a battery be used; the device could easily be arranged to be powered by ordinary house current.

Reference numeral 20 referes to a double-pole-double-throw switch shown in physical form in FIG. 1 as switch 20. This would typically be a push-button switch biased to the position shown in FIG. 11, in which it connects the battery to motor 52 for operation in the direction that would retract roller 96. When button 20 is depressed, switch 20 in FIG. 11 is operated to the position not shown in FIG. 11 so that motor 52 is operated in the direction that advances roller 64.

Figure 7:
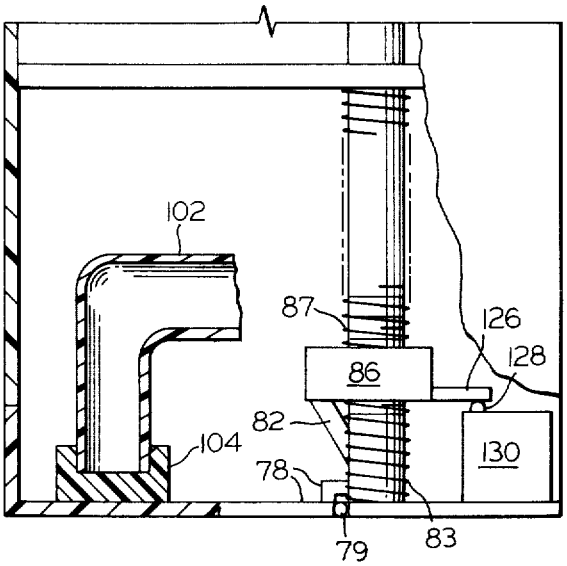
FIG. 7 is a side elevation, partly broken away, of the lower end of the dispenser showing the gate means in its closed position.
Figure 6:
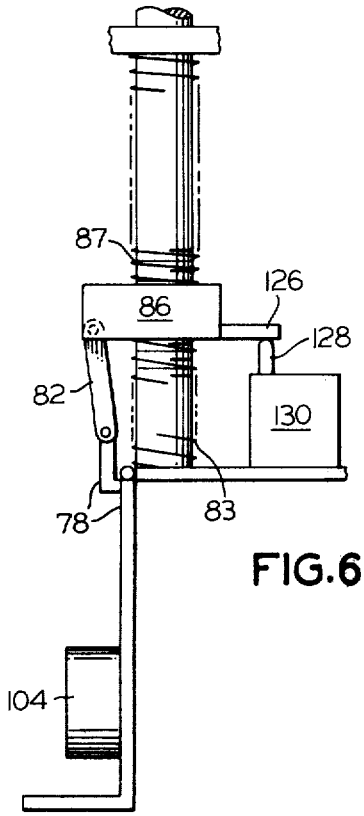
FIG. 6 is a side elevation of the means for opening and closing the gate.

Reference numeral 130 in FIG. 11 designates a double-pole-single-throw switch that corresponds to a limit switch 130 in FIGS. 6 and 7. The purpose of switch 130 is to determine when gate operating block 86 is at a position that corresponds to the closed position of gate 78. The closed position of switch 130 is shown in FIG. 7, in which plunger 128 is in its completely depressed position. In the completely depressed position, the contacts of switch 130, shown in their closed position in FIG. 11, are open. In any position between that shown in FIG. 7 and that shown in FIG. 6, the contacts are in the closed state shown in FIG. 11. The result of this arrangement is that when gate 78 is in its closed position, motor 52 will ordinarily not be permitted to operate in the direction in which it retracts roller 64, although operation of motor 52 in the other direction, and thus advancing roller 64, is permitted.

Further retraction of roller 64 after gate 78 has closed can only be performed by operation of switch 12, which overrides limit switch 130 when it is desired to completely retract roller 64 for replacement of the toothpaste tube. The further retraction of roller 64 by rotation of shafts 62 and 68 does not cause further movement of door 78, because the threads on the drive shaft run out at the lower end of travel of gate operating block 86 as well as at the upper end of its travel. Accordingly, spring 83 is provided below gate operating block 86 for a purpose similar to that of spring 87 above gate operating block 86.

To operate the FIG. 1 embodiment of the present invention, the operator depresses button 20. This applies power to electric motor 52 in a first mode, which causes it to rotate shafts 62 and 68 and thereby drive roller 64 downward, squeezing toothpaste out of the tube. At the same time, gate operating blocks 86 and 124 are driven upward because the lower threads on the shafts are the reverse of the upper threads, and this causes door 78 to open. As shafts 62 and 68 continue to rotate, gate 78 eventually reaches its fully open position, and gate operating blocks 86 and 124 are accordingly high enough on their respective shafts that they are no longer threadedly engaged with them. Accordingly, the roller can continue moving downward to dispense as much toothpaste as is desired without any further opening motion of door 78.

When the desired amount of toothpaste has been dispensed, the operator releases button 20, which thereby assumes the position shown in FIG. 11. Power is accordingly applied to motor 52 in a second mode in which roller 64 is retracted. As the shafts reverse direction, springs on the shafts such as spring 87, urge gate operating blocks 86 and 124 back into engagement with the shaft threads, and rotation of the drive shafts accordingly begins to move the door toward its closed position. This continues automatically (the operator is no longer pressing button 20) until door 78 reaches its closed position, at which point plunger 128 of limit switch 130 will have been depressed enough to open switch 130 of FIG. 11, thereby interrupting the application of power to motor 52 in the second mode. This not only stops door 78, but it also stops roller 64.

It will now be appreciated that roller 64 has been backed off somewhat from a position in which it can dispense toothpaste. This is desirable for two reasons. One reason is that it is preferred that the door be allowed to open completely before dispersing of toothpaste begins. Secondly, it is desirable that the pressure on the toothpaste be relieved so that any weakness in the tube do not result in leakage of toothpaste. Relief of the pressure also requires less force to be applied by cap 104.

It will also be appreciated at this point that the dispenser does not completely retract roller 64 after each operation. This is desirable because it is intended that roller 64 be advanced relatively slowly so that the amount of toothpaste dispensed can be easily controlled. Since the roller advances quite slowly, a considerable dalay would result if the roller were to be retracted all the way. With the present invention, however, pressure can be taken off the toothpaste, and dispensing of toothpaste during the opening of the gate can be avoided, without requiring that the roller be completely retracted or that the roller advancement be too fast for easy control.

There is thus a ratchet-type effect; the roller is advanced as much as is desired by the operator, but it is retracted only by a predetermined amount.

Figure 12:
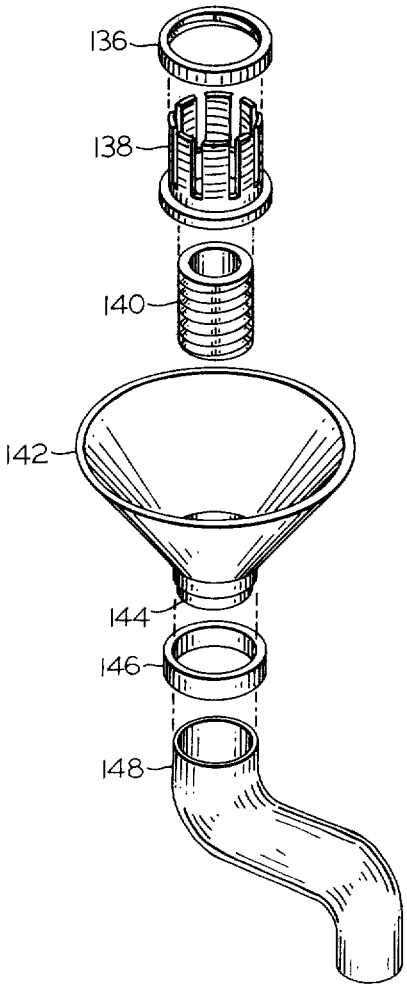
FIG. 12 illustrates an alternate arrangement of the delivery portion of the dispenser.

FIG. 12 illustrates as alternate arrangement of the toothpaste-delivery means. In this version, a funnel 142 is provided that has a neck with a relieved portion 144 over which a delivery tube 148 fits. A collar 146 fits over tube 148 and neck 144 to hold tube 148 in place.

A threaded coupling section 140 fits inside the neck of funnel 142. Its diameter is the same as that of the mouth of a conventional toothpaste tube, and the mouth of the toothpaste tube abuts coupling section 140 in operation so that toothpaste is delivered through it. A split-ring member 138 threadedly engages the exterior threads of section 140, and a locking ring 136 threadedly engages the exterior threads of split-ring member 138.

When a toothpaste tube is to be installed, locking ring 136 is rotated to drive it to the lower end of split-ring member 138. The mouth of the tube is then forced into split-ring member 138 until it abuts coupling section 140. Like gasket 106 of FIG. 3, spilt-ring member 138 is resilient and permits the toothpaste tube to be inserted without rotation. With the toothpaste tube in position, locking ring 136 is rotated to drive it upwards, and the toothpaste tube is thereby locked in place.

Figure 15:
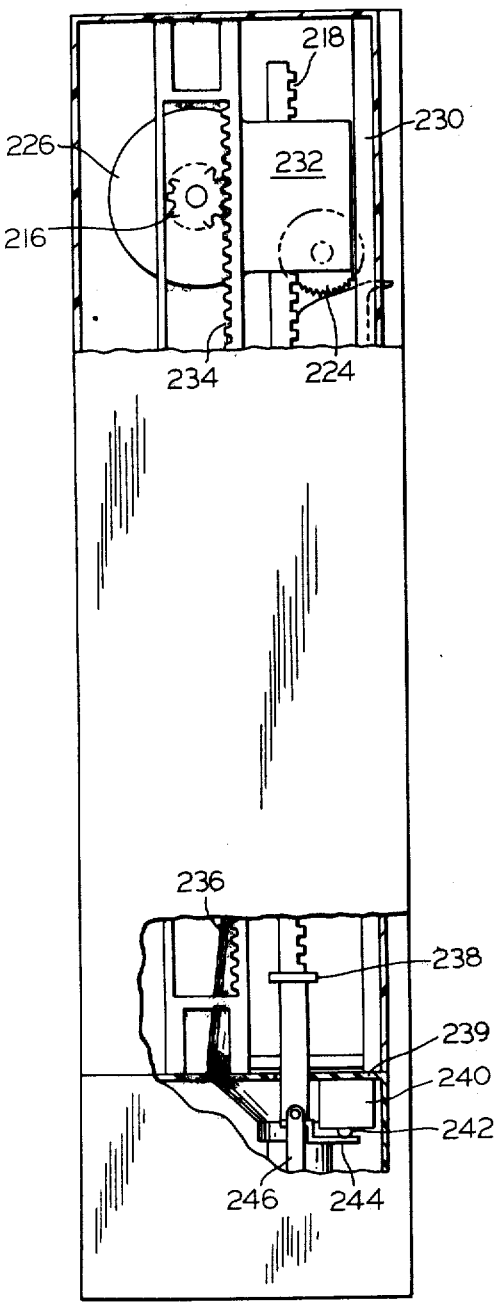
FIG. 15 is a side elevation, partly in section, of the embodiment of FIG. 13.
Figure 16:
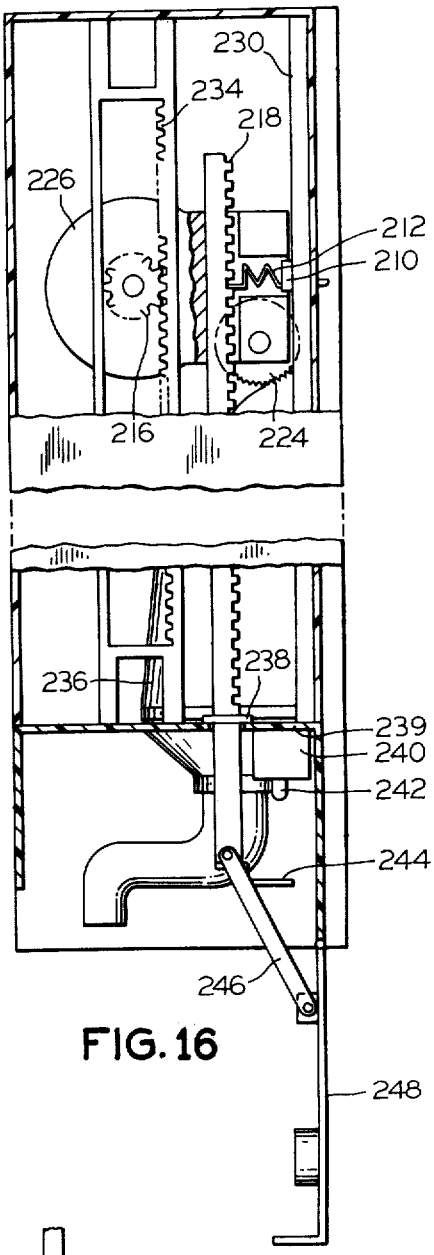
FIG. 16 is a side elevation, partly in section, of the FIG. 13 embodiment showing the gate means in its open position.

An alternate embodiment of the present invention is illustrated in FIGS. 13, 14, 15, and 16, which show a device in which the carriage for a roller 224 has a motor 226 mounted in it so that the motor moves with the carriage. A drive rod 218 moves with the carriage to operate the door 248 (FIG. 16). A stop portion 238 on drive rod 218 abuts rib 239 to prevent further motion of drive rod 18 when door 248 reaches its open position. The carriage continues downward motion without further motion of drive rod 218 because a resilient spring 212 allows rod 218 to slip relative to the carriage when stop portion 238 has bottomed. As the carriage moves back up, rod 218, whose motion is no longer prevented by stop member 238, moves upward with the carriage, thereby closing door 248.

Figure 13:
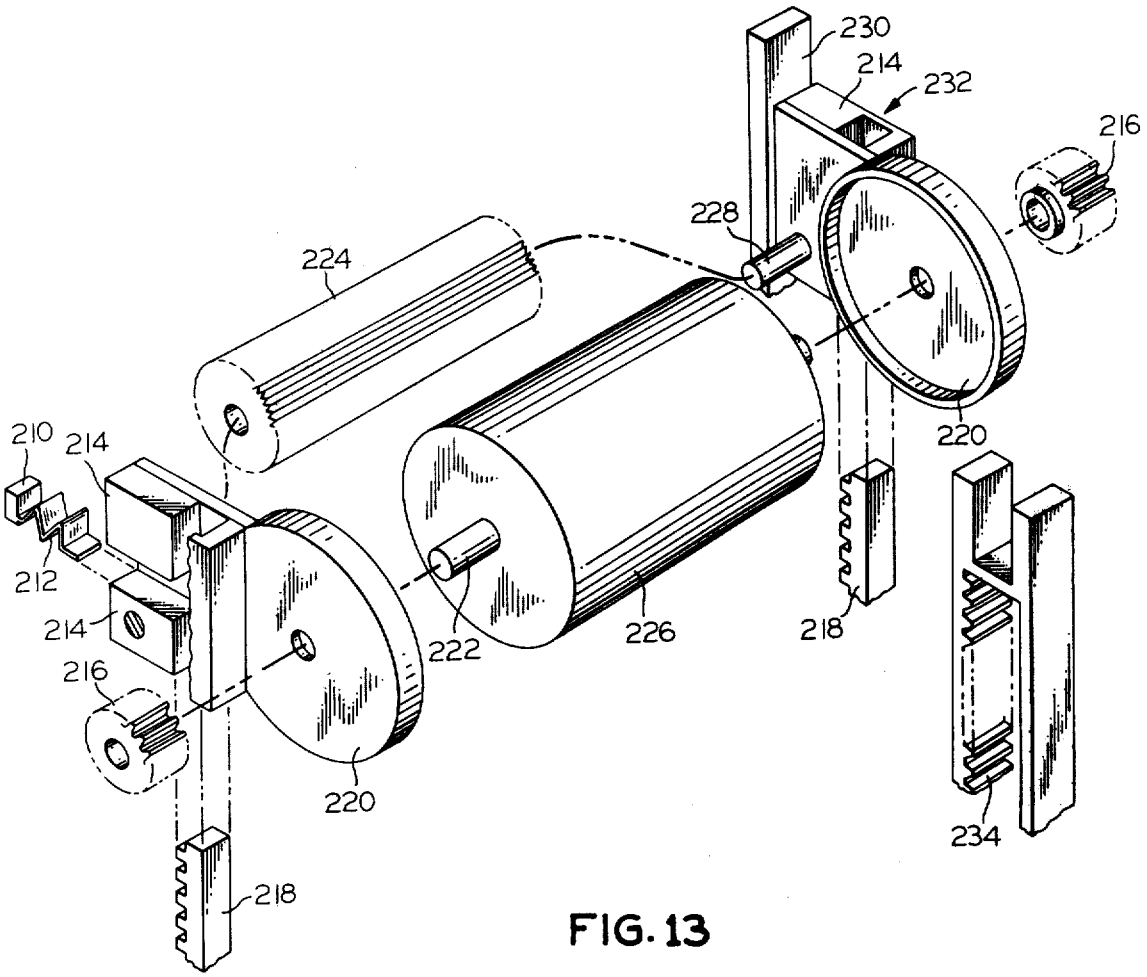
FIG. 13 is an exploded perspective view of several interior parts of an alternate embodiment of the present invention.

Simultaneous reference to FIGS. 13 and 15 will reveal that a carriage is provided for roller 224 by complementary drive-rod mounting assemblies 232. Roller mounting pins 228 project from drive-rod mounting assemblies 232, and roller 224 is mounted on mounting pins 228 for rotation relative to the carriage. The carriage further includes generally circular motor mounting plates 220, which are integral with the interior walls of the drive-rod mounting assemblies 232. As will be appreciated in light of the description below, motor mounting plates 220 press inwardly against the ends of the motor to hold it in place relative to the carriage and prevent it from rotating. Motor shaft 222 extends through holes in the motor mounting plates 220 and has drive pinions 216 that engage teeth in vertically extending stationary racks 234 (FIG. 15). By operation of motor 226, pinion 216 is rotated, causing it to move along rack 234 and accordingly carry the carriage and roller 224 with it.

Complementary racks 234 bear inwardly against motor mounting plates 220. Frictional force accordingly prevents rotation of the body of motor 226 relative to plates 220. Drive-rod mounting assembly 232 bears against the reverse side of stationary rack 234 and follows the track defined by the reverse side of rack 234 and a guide post 230 that extends vertically on the side of drive-rod mounting assembly 232 opposite stationary rack 234. This keeps pinions 216 engaged with racks 234.

Figure 14:
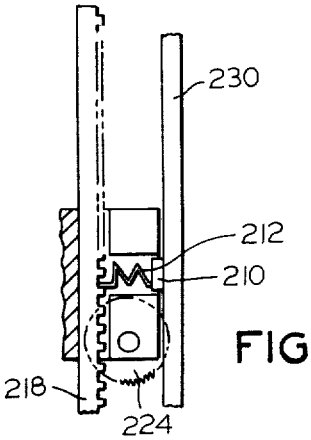
FIG. 14 is a detailed view showing the engagement between the carriage means and the drive rod in the embodiment of FIG. 13.

As is best appreciated by simultaneous reference to FIGS. 13 and 14, the drive-rod mounting assembly 232 has a passage through it in which drive rod 218 is received. The passage is defined by guide blocks 214 and an end wall of the drive-rod mounting assembly. Between guide blocks 214 is provided a spring 212 with a foot 210 that abuts guide post 230. Spring 212 is biased into engagement with the teeth of drive rod 218, and drive rod 218 is accordingly caused to move with the carriage. However, spring 212 is resiliently deflectable, and if movement of drive rod 218 is prevented, spring 212 will deflect and thus permit drive rod 218 to move vertically relative to the carriage.

The remaining description is best understood by referring to FIGS. 15 and 16. In FIG. 15, a stop portion 238 of drive rod 218 is shown spaced above a stop rib 239 provided in the housing. A limit switch 240 is mounted beneath stop rib 239, and plunger 242 of limit switch 240 is shown in FIG. 15 in the position in which it is completely depressed by an arm 224 that is mounted on drive rod 218. In this position, the switch prevents motor 226 from operating to raise the carriage unless the circuit is overridden in a manner similar to that described in connection with the embodiment of FIGS. 1–11.

FIG. 16 illustrates drive rod 218 in the open position of door 248. A gate actuating means in the form of a drive arm 246 is pivotably mounted at one end to door 248 and at the other end to drive rod 218. At the position shown in FIG. 16, door drive arm 246 holds door 248 in the completely open position, and this position is detected by the bottoming of stop portion 238 on stop rib 239. As was mentioned before, this prevents further downward motion of drive rod 218 and further motion of door 248 in the open direction. Nonetheless, the carriage can continue its downward movement if the motor is operated in that direction because spring 212 resiliently deflects to permit the carriage to slide relative to drive rod 218.

In operation, the embodiment of FIGS. 13 through 16 is similar to that of the previous embodiment. An operating button is depressed, causing power to be applied to motor 226 in a first mode, in which drive pinion 216 is caused to rotate and thus drive the carriage downward, carrying roller 224 along with it to squeeze toothpaste out of the tube. As the carriage moves downward, drive rod 218 is carried with it because of it engagement by spring 212. The downward movement of rod 218 continues until stop portion 238 abuts stop rib 239 provided in the housing, at which point door 248 is completely open. Continued depression of the operating button causes continued downward motion of the carriage, but resilient deflection of spring 212 permits rod 218 to remain stationary during the downward motion. The result is that door 248 stays in place while toothpaste is being squeezed out of the associated toothpaste tube.

When enough toothpaste has ben dispensed, the operator releases the operating button, and power is thereby applied to motor 226 in its second mode, in which the motor is reversed so that the carriage is moved back upward. Since stop portion 238 does not prevent upward motion of rod 218, rod 218 moves upward with the carriage. This movement continues until are 244 on rod 218 engages plunger 242 and moves it to the completely depressed position. This interrupts the application of power in the second mode, and upward motion of the carriage and drive 218 is accordingly stopped. Thus, the ratchet effect observed in the operation of the embodiment of FIGS. 1 through 2 is also present in the embodiment of FIGS. 13 through 16.

When it is deisred to completely retract the carriage to change toothpaste tubes, limit switch 240 can be overridden in the same manner as that which was employed in connection with the embodiment of FIGS. 1–12. This causes the carriage to move upwardly past the point at which door 248 reaches its closed position. When the closed position of door 248 is reached, rod 218 is prevented from moving upward because arm 244 bears against the completely depressed plunger 242, and rod 218 is againg permitted to slip relative to the carriage. Alternately, the drive rod 218 could be made long enough to abut the upper wall of the housing when the closed position of door 248 is reached. In either case, the carriage moves to the totally retracted position while door 248 remains stationary.

It will be appreciated that application of the trachings of the present invention will provide an advantageous toothpaste dispenser. The ratchet effect afforded by the arrangement of the embodiments described above permits pressure on the toothpaste tube to be avoided during periods in which the dispenser is not operated, but the necessity for complete retraction of the roller between uses is avoided. This both reduces the likelihood of toothpaste leakage and allows for close control of the amount of toothpaste delivered without requiring a long delay between the beginning of motor operations and actual squeezing of the tube.

Having thus discribed the invention, we claim:

1. A toothpaste dispense comprising:

a. a housing having first and second axes and adapted for mounting an elongated toothpaste tube therein with the longitudinal axis of the associated tube extending along said first axis;

b. squeeze means movably mounted in said housing for movement along said first axis to squeeze the assoicated toothpaste tube mounted in said housing;

c. drive means mounted in said housing and operable in first and second directions, said drive means being operatively engaged with said squeeze means for moving said squeeze means along said first axis to squeeze toothpaste out of the associated toothpaste tube mounted in said housing when said drive means is operated in said first direction and for moving said squeeze means in the opposite direction when said drive means is operated in said second direction;

d. gate means on said housing movable between a closed position, in which said gate means is positioned to prevent the flow of toothpaste out of the associated toothpaste tube mounted in said housing, and an open position in which said flow is permitted, said gate means being operatively engaged with said drive means for movement of said gate means to said closed position when said drive means is operated is said second direction and movement of said gate means to said open position when said drive means is operated in said first direction, said gate means remaining in said open position when said drive means continues to operate in said first direction; and e. means operable upon movement of said gate means to said closed position to stop the movement of said squeeze means in said opposite direction, said squeeze means thereby being enabled to start its squeezing action at successively farther-advanced positions along the associated toothpaste tube after successive closures of said gate means.

2. The toothpaste dispenser of claim 1 wherein said drive means includes an elongated drive shaft having its longitudinal axis extending parallel to said first axis of said housing and mounted in said housing for rotation about its longitudinal axis, said drive means further including carriage means and gate operating means, said carriage and gate operating means being mounted on said drive shaft for movement theralong, said squeeze means being mounted in said carriage means for movement therewith along said drive shaft, said gate operating means being operatively connected to said gate means for movement thereof between said open and closed positions upon movement of said gate operating means along said drive shaft, said carriage means and said gate operating means being threadedly engaged with said drive shaft for movement of said gate operating means along said drive shaft to move said gate means toward its open position and movement of said carriage means and thereby of said squeeze means along said drive shaft to squeeze toothpaste out of the associated tube upon rotation of said drive shaft in one way, said threaded engagment producing movement of said gate operating means along said drive shaft to move said gate means toward its closed position and movement of said carriage means and thereby of said squeeze means along said shaft in said opposite direction when said drive shaft is rotated the other way.

3. The toothpaste dispenser of claim 2 wherein:

a. said drive means includes an electric motor mounted in said housing and operatively engaged with said drive shaft for rotation of said drive shaft upon operation of said electric motor, said drive means further including circuit means connected to said electric motor, adapted for connection to a source of electric power, and operable when connected to the source of electric power to alternately apply the power in first and second modes to said electric motor to rotate said drive shaft said one way in said first mode and said other way in said second mode; and b. said means for stopping movement of said squeeze means includes switch means electrically interposed in said circuit means and operable by the reaching of said closed position by said gate means to interrupt the application of power in said second mode.

4. The toothpaste dispenser of claim 2 wherein said squeeze means includes a roll rotatably mounted in said carriage means for engagement with the associated toothpaste tube, said roll being permitted to rotate as said squeeze means is moved to squeeze toothpaste out of the associated toothpaste tube.

5. The toothpaste dispenser of claim 2 wherein the threads on said drive shaft and said gate operating means providing said threaded engagement therebetween are longitudinally positioned for disengagement when said gate operating means reaches its position on said shaft corresponding to said open position of said gate, continued rotation of said drive shaft in said one way and thus continued squeezing being permitted without further movement of said gate in the direction of said open position, but rotation of said drive shaft in said other way, when said gate means is in said open position causing movement of said gate operating means to move said gate means from said open position toward said closed position.

6. The toothpaste dispenser of claim 5 wherein:

a. said drive means includes an electric motor mounted in said housing and operatively engaged with said drive shaft for rotation of said drive shaft upon operation of said electric motor, said drive means further including circuit means connected to said electric motor, adapted for connection to a source of electric power, and operable when connected to the source of electric power to alternately apply the power in first and second modes to said electric motor to rotate said drive shaft said one way in said first mode and said other way in said second mode; and b. said means for stopping movement of said squeeze means includes switch means electrically interposed in said circuit means and operable by the reaching of said closed position by said gate means to interrupt the application of power in said second mode.

7. The toothpaste dispenser of claim 6 wherein said drive means further includes a second drive shaft operatively engaged with said motor and threadedly engaged with said carriage means and said gate operating means for simultaneous movement of said carriage means and said gate operating means along said first-mentioned drive shaft and said second drive shaft.

8. The toothpaste dispenser of claim 1 wherein said drive means includes an elongated drive rod mounted in said housing with its longitudinal axis extending parallel to said first axis for longitudinal movement relative to said housing, said drive means further including carriage means and gate operating means engaging said drive rod for movement therewith along said first axis, said squeeze means being mounted in said carriage means for movement therewith, said gate operating means being operatively engaged with said gate means for movement thereof between said open and closed positions upon movement of said gate operating means with said drive rod. said carriage means engaging said drive rod for longitudinal movement of said drive rod and said gate operating means to move said gate means toward said open position when said carriage means moves with said squeeze means to squeeze toothpaste out of the associated tube and for longitudinal movement of said drive rod and said gate operating means to move said gate means toward said closed position when said carriage means moves with said squeeze means in said opposite direction.

9. The toothpaste dispenser of claim 8 wherein:

a. said drive means includes an electric motor mounted in said carriage means and operatively engaged with said housing movement of said motor and said carriage along with first axis upon operation of said electric motor, said drive means further including circuit means connected to said electric motor adapted for connection to a source of electric power, and operable when connected to the source of electric power to alternately apply the power in first and second modes to said electric motor, said motor, carriage means, and squeeze means moving to squeeze toothpast out of the associated tube when power is applied to said electric motor in said first mode, said motor, carriage means, and squeeze means moving in the opposite direction when power is applied to said electric motor in said second mode; and b. said means for stopping movement of said squeeze means includes switch means electrically interposed in said circuit means and operable by the reaching of said closed position by said gate means to interrupt the application of power in said second mode.

10. The toothpaste dispenser of claim 8 wherein said squeeze means includes a roll rotatably mounted in said carriage means for engagement with the associated toothpaste tube, said roll being permitted to rotate as said squeeze means is moved to squeeze toothpaste out of the associated toothpaste tube.

11. The toothpaste dispenser of claim 8 wherein said drive rod includes stop means thereon for engaging said housing upon said drive rod reaching the position corresponding to said open position of said gate means, said engagement of said housing by said stop means preventing further longitudinal motion of said drive rod with said carriage means and said squeeze means as they continue motion to squeeze toothpaste out of the associated toothpaste tube but permitting motion of said drive rod with said carriage means and said squeeze means in said opposite direction, said engagement of said drive rod by said carriage means permitting slipping of said drive rod relative to said carriage means when said stop means prevents further movement of said drive rod.

12. The toothpaste dispenser of claim 11 wherein:

a. said drive means includes an electric motor mounted in said carriage means and operatively engaged with said housing for movement of said motor and said carriage along with first axis upon operation of said electric motor, said drive means further including circuit means connected to said electric motor, adapted for connection to a source of electric power, and operable when connected to the source of electric power to alternately apply the power in first and second modes to said electric motot, said motor, carriage means, and squeeze means moving to squeeze toothpaste out of the associated tube when power is applied to said electric motor in said first mode, said motor, carriage means, and squeeze means moving in the opposite direction when power is applied to said electric motor in said second mode; and b. said means for stopping movement of said squeeze means includes switch means electrically interposed in said circuit means and operatble by the reaching of said closed position by said gate means to interrupt the application of power in said second mode.

13. The toothpaste dispenser of claim 1 wherein:

a. said drive means includes an electric motor and circuit means connected to said electric motor, adapted for connection to a source of electric power, and operable when connected to the source of electric power to alternately apply the power in first and second modes to said electric motor, said drive means operating in said first and second directions when power is applied to said motor in said first and second modes, respectively; and b. said means for stopping movement of said squeeze means includes switch means electrically interposed in said circuit means and operably by the reaching of said closed position by said gate means to interrupt the applicaton of power in said second mode.

14. The toothpaste dispenser of claim 6, 12, or 13 wherein said switch means is operable by said gate means upon movement to said closed position to interrupt the application of power in said second mode.

15. The toothpaste dispenser of claim 14 wherein said circuit means includes a manually operable switch having two states, a first state in which said circuit means applies power to said electric motor in said first mode and a second state in which said circuit means applies electric power to said motor in said second mode, said switch being operable to assume said first state upon manual manipulation of said manually operable switch and biased to assume said second state upon release of said manually operable switch.

16. The toothpaste dispenser of claim 6, 12, or 13 wherein said circuit means includes a manually operable switch having two states, a first state in which said circuit means applies power to said electric motor in said first mode and a second state in which said circuit means applies electric power to said motor in said second mode, said switch being operable to assume said first state upon manual manipulation of said manually operable switch and biased to assume said second state upon release of said manually operable switch.

* * * * *